US006649841B2

(12) United States Patent
Chopra et al.

(10) Patent No.: US 6,649,841 B2
(45) Date of Patent: Nov. 18, 2003

(54) CORRUGATED COAXIAL CABLE WITH HIGH VELOCITY OF PROPAGATION

(75) Inventors: Vijay K. Chopra, Palos Park, IL (US); Hugh R. Nudd, Mokena, IL (US); James A. Krabec, Oak Lawn, IL (US)

(73) Assignee: Andrew Corporation, Orland Park, IL (US)

( * ) Notice: Subject to any disclaimer, the term of this patent is extended or adjusted under 35 U.S.C. 154(b) by 14 days.

(21) Appl. No.: 09/990,105

(22) Filed: Nov. 21, 2001

(65) Prior Publication Data

US 2002/0096354 A1 Jul. 25, 2002

Related U.S. Application Data

(60) Provisional application No. 60/250,562, filed on Dec. 1, 2000, and provisional application No. 60/298,451, filed on Jun. 15, 2001.

(51) Int. Cl.[7] ..... H01B 7/18

(52) U.S. Cl. ..... 174/102 R; 174/102 D

(58) Field of Search ..... 174/28, 36, 102 R, 174/102 D, 110 R, 110 F, 106 D, 107, 21 C, 110 PM

(56) References Cited

U.S. PATENT DOCUMENTS

| | | | | |
|---|---|---|---|---|
| 3,193,712 A | | 7/1965 | Harris et al. | 307/147 |
| 3,309,455 A | | 3/1967 | Mildner et al. | 174/29 |
| 3,745,232 A | | 7/1973 | Johnson et al. | 174/107 |
| 4,104,481 A | | 8/1978 | Wilkenloh et al. | 174/28 |
| 4,107,354 A | | 8/1978 | Wilkenloh et al. | 427/118 |
| 4,220,807 A | | 9/1980 | Anastasi et al. | 174/36 |
| 4,339,733 A | * | 7/1982 | Smith | 333/237 |
| 4,340,773 A | * | 7/1982 | Perreault | 174/107 |
| 4,368,350 A | * | 1/1983 | Perelman | 174/102 D |
| 4,472,595 A | | 9/1984 | Fox et al. | 174/36 |
| 4,758,685 A | * | 7/1988 | Pote et al. | 174/29 |
| 4,894,488 A | | 1/1990 | Gupta | 174/28 |
| 5,110,998 A | | 5/1992 | Muschiatti | 174/24 |
| 5,210,377 A | * | 5/1993 | Kennedy et al. | 174/107 |
| 5,235,299 A | * | 8/1993 | Vaille et al. | 333/243 |
| 5,239,134 A | | 8/1993 | Pote et al. | 174/102 |
| 5,274,712 A | | 12/1993 | Lindsay et al. | 381/77 |
| 5,286,924 A | | 2/1994 | Loder et al. | 174/117 |
| 5,393,929 A | | 2/1995 | Yagihashi | 174/36 |
| 5,521,331 A | | 5/1996 | Hillburn | 174/36 |
| 5,527,573 A | | 6/1996 | Park et al. | 428/314 |
| 5,831,215 A | * | 11/1998 | Ziemek et al. | 174/108 |
| 5,926,949 A | | 7/1999 | Moe et al. | 29/828 |
| 5,959,245 A | | 9/1999 | Moe et al. | 174/36 |
| 6,037,545 A | | 3/2000 | Fox et al. | 174/110 |
| 6,137,058 A | | 10/2000 | Moe et al. | 174/102 |

FOREIGN PATENT DOCUMENTS

| | | | | |
|---|---|---|---|---|
| DE | 3204761 A | * | 8/1983 | H01B/11/18 |
| WO | WO 98/13834 | | 4/1998 | |

* cited by examiner

*Primary Examiner*—William H. Mayo, III
(74) *Attorney, Agent, or Firm*—Jenkens & Gilchrist

(57) ABSTRACT

A corrugated coaxial cable including a core with at least one inner conductor and a highly expanded polymeric foam dielectric surrounding the inner conductor. This coaxial cable has a corrugated outer conductor closely encapsulating the foam dielectric. The corrugated coax cable is dimensioned to provide the cable with a velocity of propagation of greater than 90% of the speed of light.

18 Claims, 7 Drawing Sheets

CORRUGATED COAXIAL CABLE WITH HIGH VELOCITY OF PROPAGATION

CROSS-REFERENCE TO RELATED APPLICATIONS

This application claims the benefit of priority of U.S. Provisional Patent Application Ser. No. 60/250,562 filed on Dec. 1, 2000, and U.S. Provisional Patent Application Serial No. 60/298,451 filed on Jun. 15, 2001.

BACKGROUND

1. Technical Field of the Invention

The present invention relates to corrugated coaxial cables.

2. History of Related Art

Historically, coaxial cables for transmission of RF signals have been available with either smooth wall or corrugated outer conductors. These two different constructions offer particular advantages to the end users. For the same physical cable size and density of the foam dielectric, a smooth wall outer conductor coax construction offers higher velocity of propagation and lower attenuation but inferior bending and handling characteristics when compared to an equivalent cable with a corrugated outer conductor. When good handling and bending characteristics are important, coaxial cables with corrugated outer conductors have usually been used. This mechanical improvement is achieved, however, by some degradation of important electrical performance characteristics. The corrugated outer conductor by virtue of its geometric shape increases the capacitance of the cable. This reduces the velocity of the transmitted signal, and also increases the attenuation in a cable of fixed size because of the reduction in the diameter of the inner conductor of the cable, which is needed to maintain the required characteristic impedance. Additionally, during the manufacturing process to create corrugations and proper physical fit, the foam dielectric is compressed somewhat more than for smooth wall outer designs, resulting in denser dielectric and creating a higher dielectric constant medium. Until now, these factors have combined to place a practical limit on the velocity of a corrugated foam dielectric coaxial cable of rather less than 90%. The highest velocity in a commercially available cable of this type has been 89%.

Whether in a coaxial cable of smooth wall or corrugated outer conductor construction, achieving the highest practical velocity of signal propagation is advantageous, because this results in the lowest attenuation for a cable with fixed characteristic impedance and fixed size. The characteristic impedance is always set by system requirements, and is therefore fixed. The impedance of the cable has to be the same as that of the equipment items to which it is connected to minimize disrupting signal reflections. Wireless infrastructure systems typically use equipment with a 50 ohm characteristic impedance, while CATV (cable television) systems are usually 75 ohms. Cables are available in various sizes, larger sizes having lower attenuation than smaller sizes, and the lowest attenuation in a given size is advantageous because undesirable signal loss is minimized. In some cases the lower attenuation can allow a smaller cable to be used than would otherwise be possible, which is economically beneficial.

For a smooth wall cable, the relative propagation velocity (i.e., the velocity as a fraction of the velocity of light in air) is the reciprocal of the square root of the dielectric constant of the foam, and the dielectric constant is known for any particular foam density from equations available in the literature. To achieve a 90% propagation velocity for a smooth wall cable with a foamed polyethylene dielectric requires a foam density of approximately 0.22 g/cm$^3$. In a corrugated cable, however, the electrical effect of the corrugations is to increase the capacitance of the cable and thus to decrease the velocity of propagation by a few percentage points. Corrugated cables that have been available for some years, and which have a velocity of propagation of 88% or 89% typically require a foam density of 0.18 g/cm$^3$ or less, and consequently require a more advanced foam processing technology than do smooth wall cables, even with 90% or higher velocity. To view the difference another way, a smooth wall cable using a foam dielectric of the same density as has been used with corrugated cables for some years would have a velocity of 93% or greater.

SUMMARY OF THE INVENTION

In accordance with the present invention, there is provided a coaxial cable comprising an inner conductor, a foamed polymeric dielectric surrounding the inner conductor and having a foam density below 0.17 g/cm$^3$, and a corrugated outer conductor surrounding the dielectric and dimensioned to provide the cable with a velocity of propagation greater than 90% of the speed of light, the corrugations in the outer conductor forming troughs and crests with the troughs engaging said dielectric.

The present invention provides a new design for corrugated cables which further improves the balance of electrical and mechanical characteristics attainable. Foam densities and corrugation dimensions are precisely controlled to realize a corrugated coaxial cable that retains the excellent flexibility and handling properties of corrugated cables and yet has a propagation velocity of 90% or greater, and with consequent improvement in attenuation.

DETAILED DESCRIPTION

The improved coaxial cable of this invention utilizes optimizations of both the outer conductor corrugations and the characteristics of the foam dielectric.

At densities near 0.17 g/cm$^3$, a relative velocity of propagation above 90% may be achieved by controlling the Outer conductor Developed corrugation Length Ratio (ODLR). The ODLR typically must be below 1.11 for a 1-inch diameter cable. To maintain the highly desirable flexibility and flex life (30 reverse bends) associated with corrugated cables, the ODLR is preferably above 1.10. These specific values may vary with cable size.

ODLR is defined as the actual length of a corrugated outer conductor divided by its lineal length. It takes into account the effects of corrugation pitch and depth. The ODLR increases if the ratio of the corrugation depth to the corrugation pitch increases. (The ODLR is 1.0 for smooth wall cable designs.)

Figure 1B:
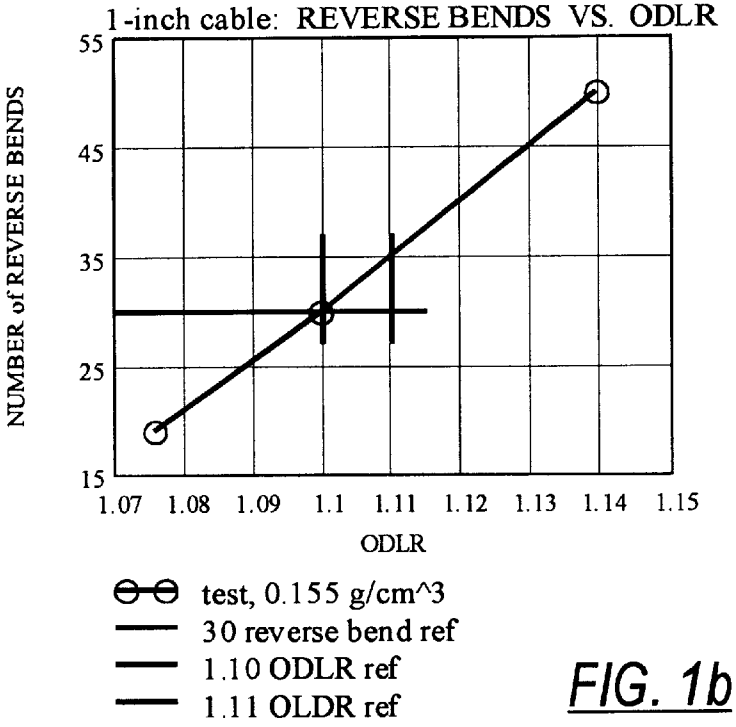
FIGS. 1*a* and 1*b* are graphs of cable performance characteristics as a function of ODRL for a nominal one-inch corrugated cable.
Figure 1A:
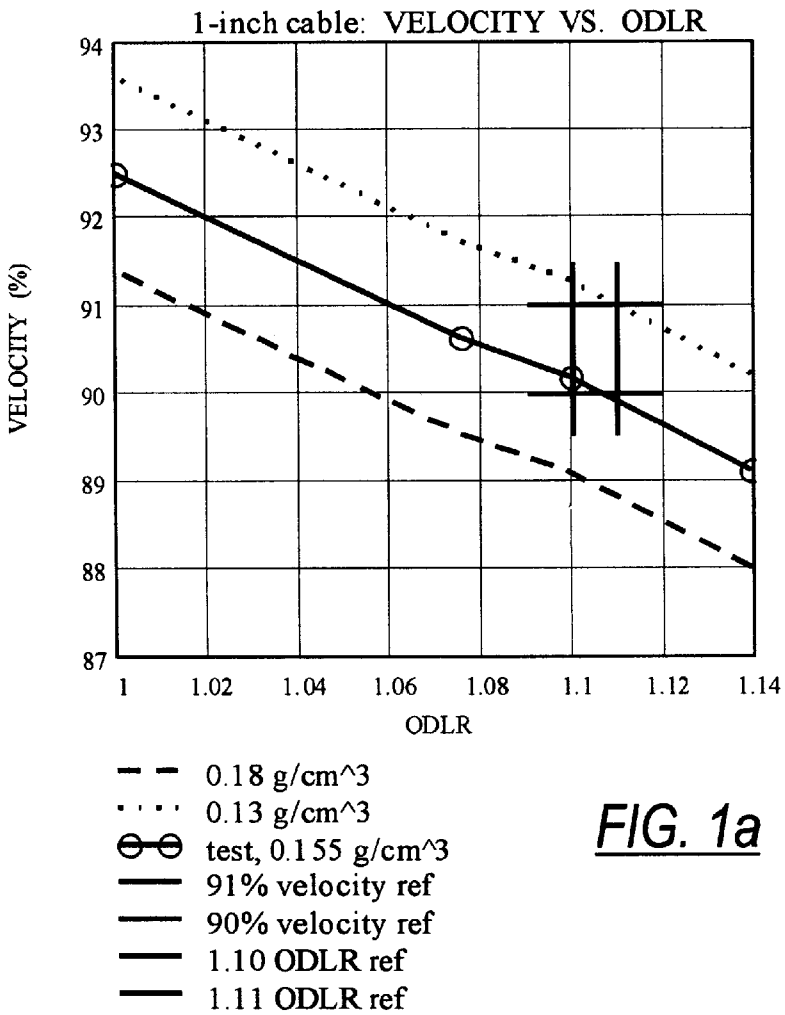

Mechanical properties (flexibility or Number of Reverse Bends) and RF signal transmission efficiency (Velocity of propagation) in a corrugated coaxial cable are conflicting attributes as the ODLR is varied, as can be seen from the slopes of the two graphs depicted in FIG. 1. In one embodiment of this invention, for a 1-inch diameter cable, it can be seen that near a 0.14 g/cm$^3$ density, the ODLR must be maintained between 1.10 and 1.11 to achieve 91% or higher Velocity of propagation and 30 reverse bends flex life. The reverse bend performance is not measurably affected within the density range depicted. Data for the 1-inch diameter cable having density near 0.16 g/cm$^3$, shown in FIG. 1, shows 30 reverse bends for an ODLR near 1.10. A similar 1-inch cable having a density near 0.14 g/cm$^3$, depicted in FIG. 1, also achieved 30 reverse bends.

Figure 2B:
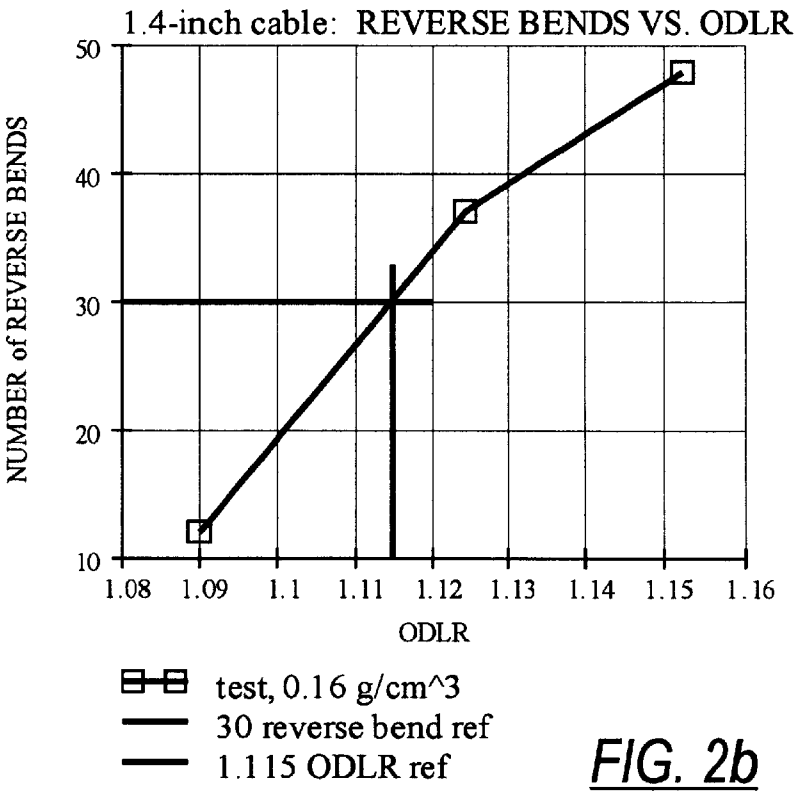
FIGS. 2*a* and 2*b* are graphs of cable performance characteristics as a function of ODRL for a nominal 1.4-inch corrugated cable.
Figure 2A:
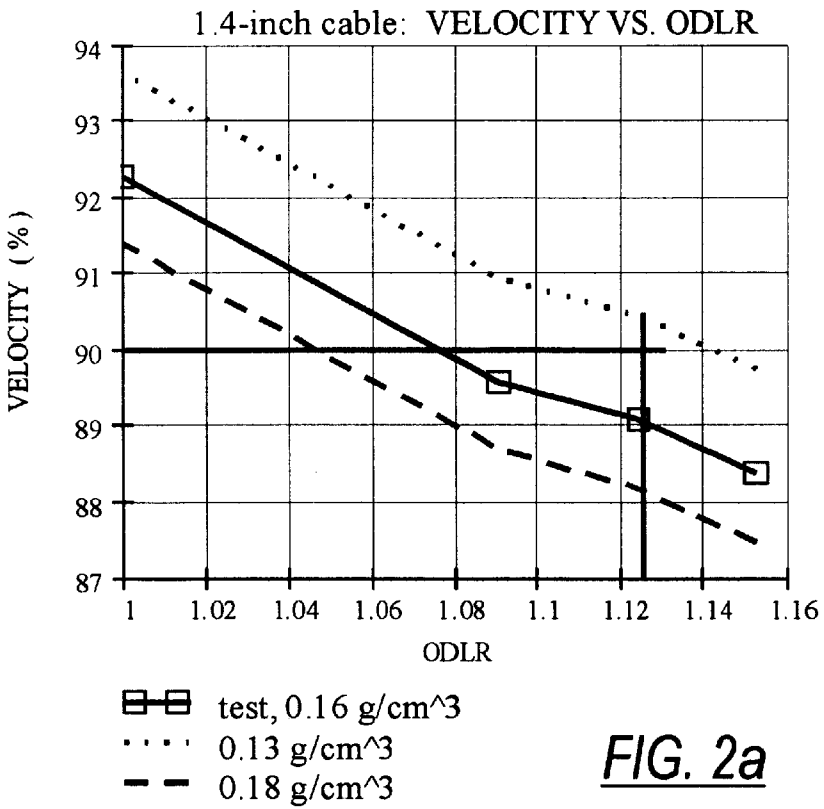

It must be recognized that the specific relationships depicted in FIG. 1 will be slightly different for different size cable, conductor material and dielectric foam density. In a second embodiment of this invention, for example, FIG. 2 illustrates the same tests performed on a 1.4-inch diameter cable. For the 1.4-inch diameter cable in FIG. 2, 90% velocity is seen to be achieved at a density near 0.14 g/cm$^3$ and an ODLR about 1.125 or lower. To maintain a reverse bend value near 30, the ODLR must be about 1.115, or higher.

Figure 3:
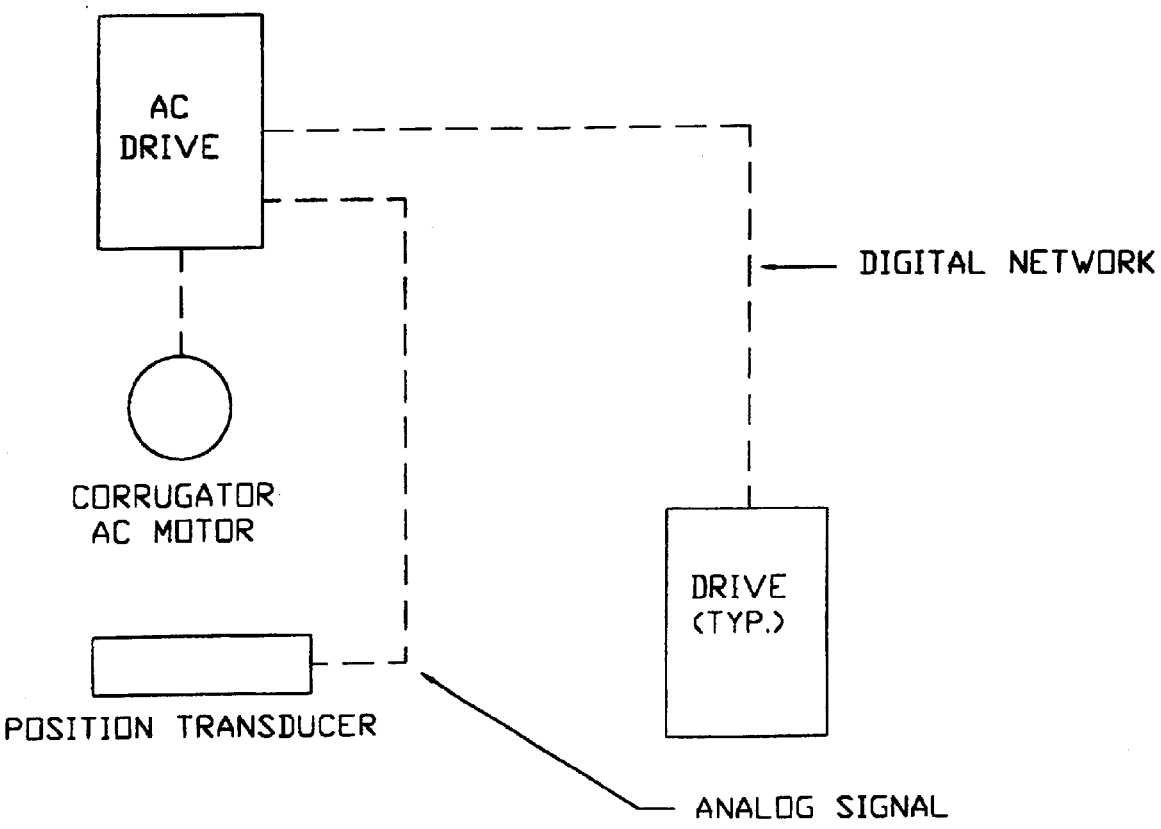
FIG. 3 is block diagram of a corrugating control system.

FIG. 3 illustrates a corrugating control system that includes an AC drive, an AC corrugator motor, and a position transducer. The AC drive communicates with the position transducer via an analog signal, and the corrugator drive sends signals to, and receives signals from, the other drives in the system via a high-speed, digital network. All control is done within the AC drive. The result is precise control of the process and the corrugation depth. The digital approach is relatively insensitive to outside influences (i.e. electrical noise) and provides a high degree of resolution.

To monitor the dimensions of the cable during the corrugation process, an automated, computer-based, visual measurement system determines corrugation dimensions in situ. This control mechanism allows tolerances to be held tight, thus improving the velocity of propagation and uniformity of dimensions in the resulting cable.

The foam dielectric process preferably employs an AC drive on the foam extruder to attain a smooth speed response from the drive, as well as precise process control. This process control allows the foam dielectric to be extruded at a consistently low foam density, which contributes to the high velocity of propagation of the resulting cable. Other aspects of the foaming process that contribute to a consistently low foam density are the maintenance of a high gas injection pressure within a very narrow range and a more precise control over the proportions of materials being blended in the extrusion process.

Optimization of the foam dielectric results from advanced foam processing technology, and achieves both a reduction in overall foam density and an advantageous gradient in foam density without requiring multiple extrusions. The density increases radially from inner to outer conductor. As with foam dielectric cables prior to this invention too, the foam is required to be closed cell to prohibit migration of water and thus to provide a high quality product which will give reliable service.

Figure 4:
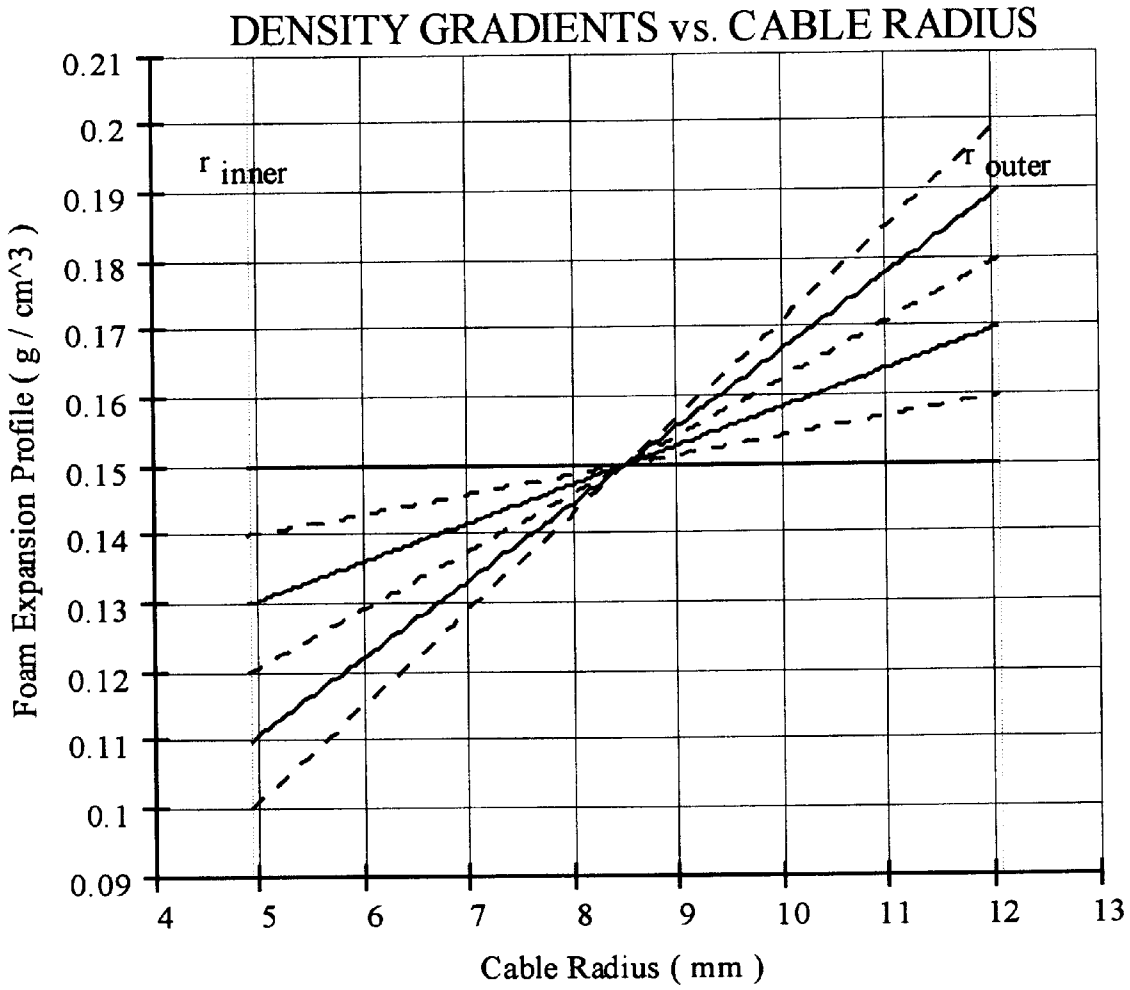
FIG. 4 is a graph of foam density as a function of cable radius.
Figure 5:
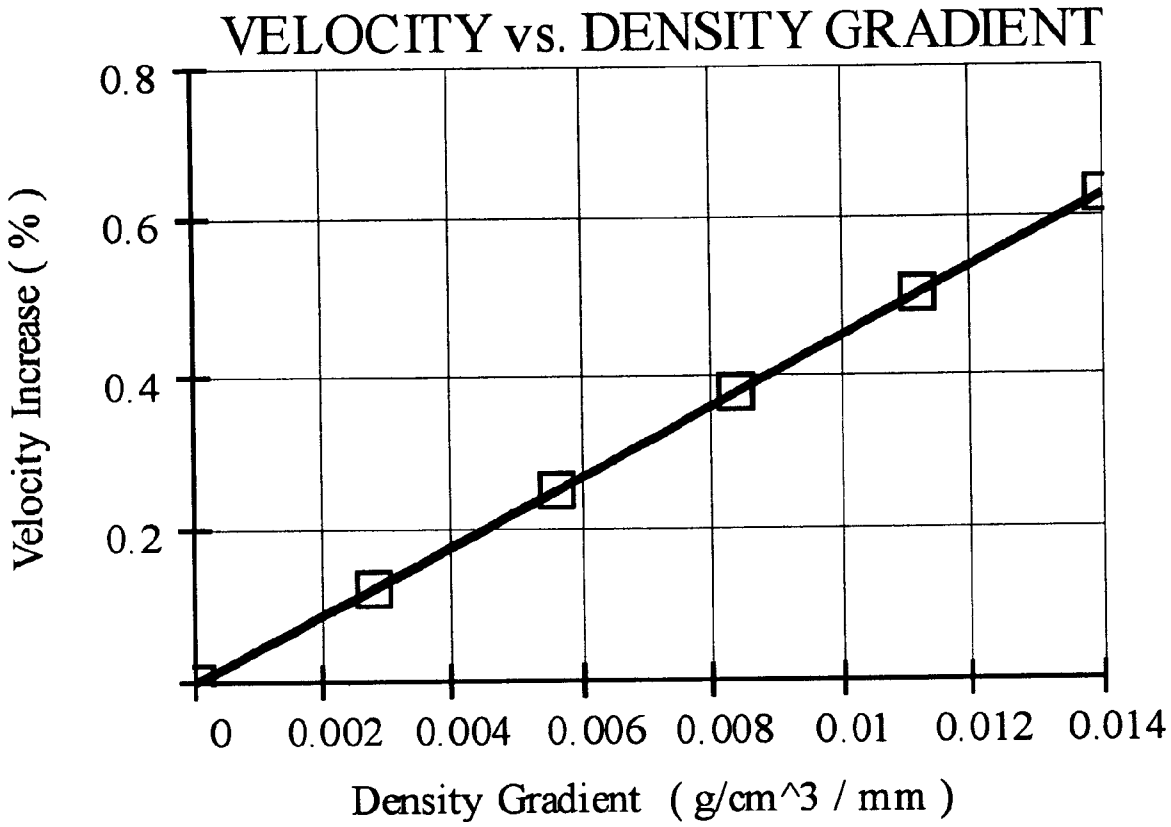
FIG. 5 is a graph of velocity increase as a function of foam density.
Figure 6:
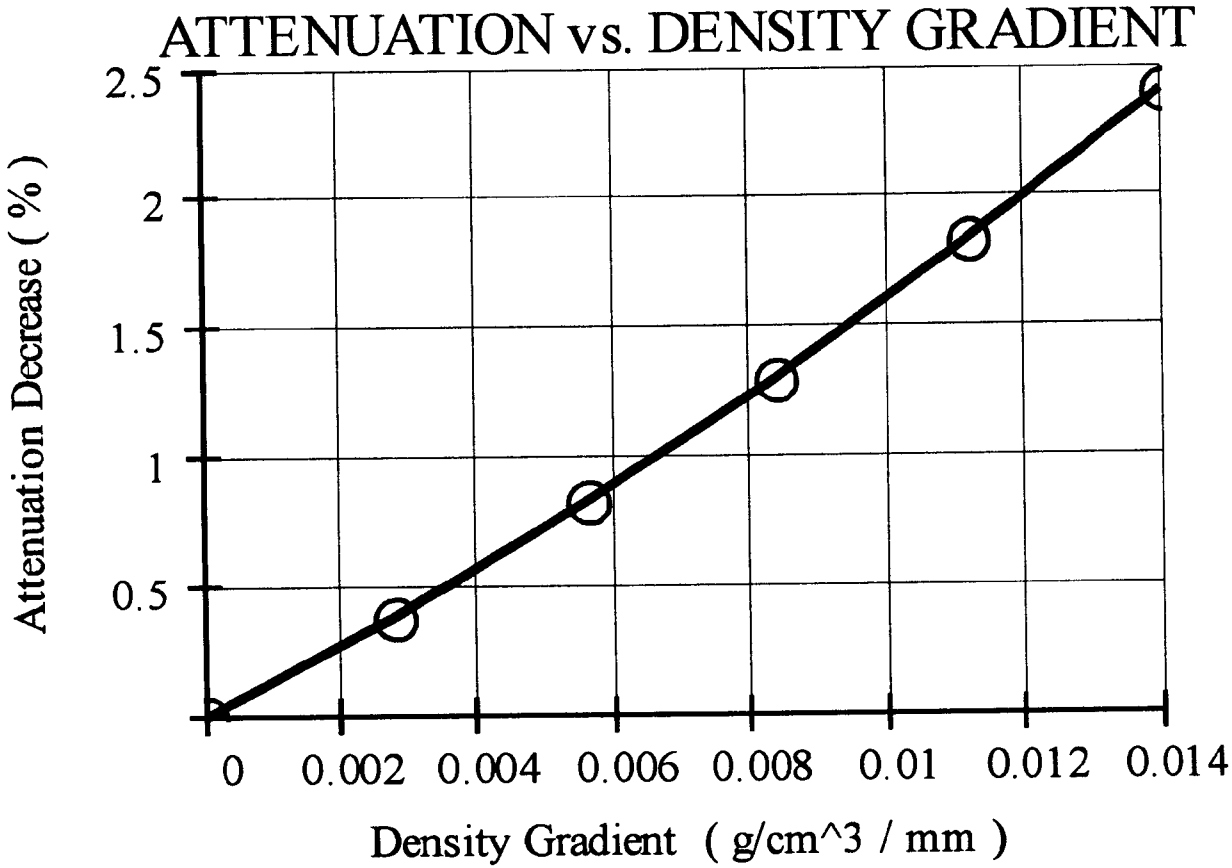
FIG. 6 is a graph of attenuation decrease as a function of foam density.

Although a 90% velocity cable can be made with uniform foam, a gradient in the foam density aids in achieving the higher velocity and consequently the lower attenuation desired in the final design. Taking advantage of this effect allows the cable performance to be further improved within current foam processing technology. Foam density variations of typically 20% or more, increasing radially from inner to outer, are obtained. For a 1 inch cable, this results in a velocity increase near 0.5% and a reduction in attenuation of near 1% when compared to cable made with uniform foam of the same weight. FIG. 4 illustrates examples of foam density profiles that have increasingly larger constant gradients. The dimensions are applicable to cable designs near 1 inch diameter. Assuming a thin adhesive layer over the inner conductor (about 0.005 inch thickness), FIGS. 5 and 6 show the improvements in velocity and attenuation due to these gradient designs compared to designs with uniformly expanded foams of the same mass. As the gradient increases, the improvement in attenuation performance increases.

Figure 7:
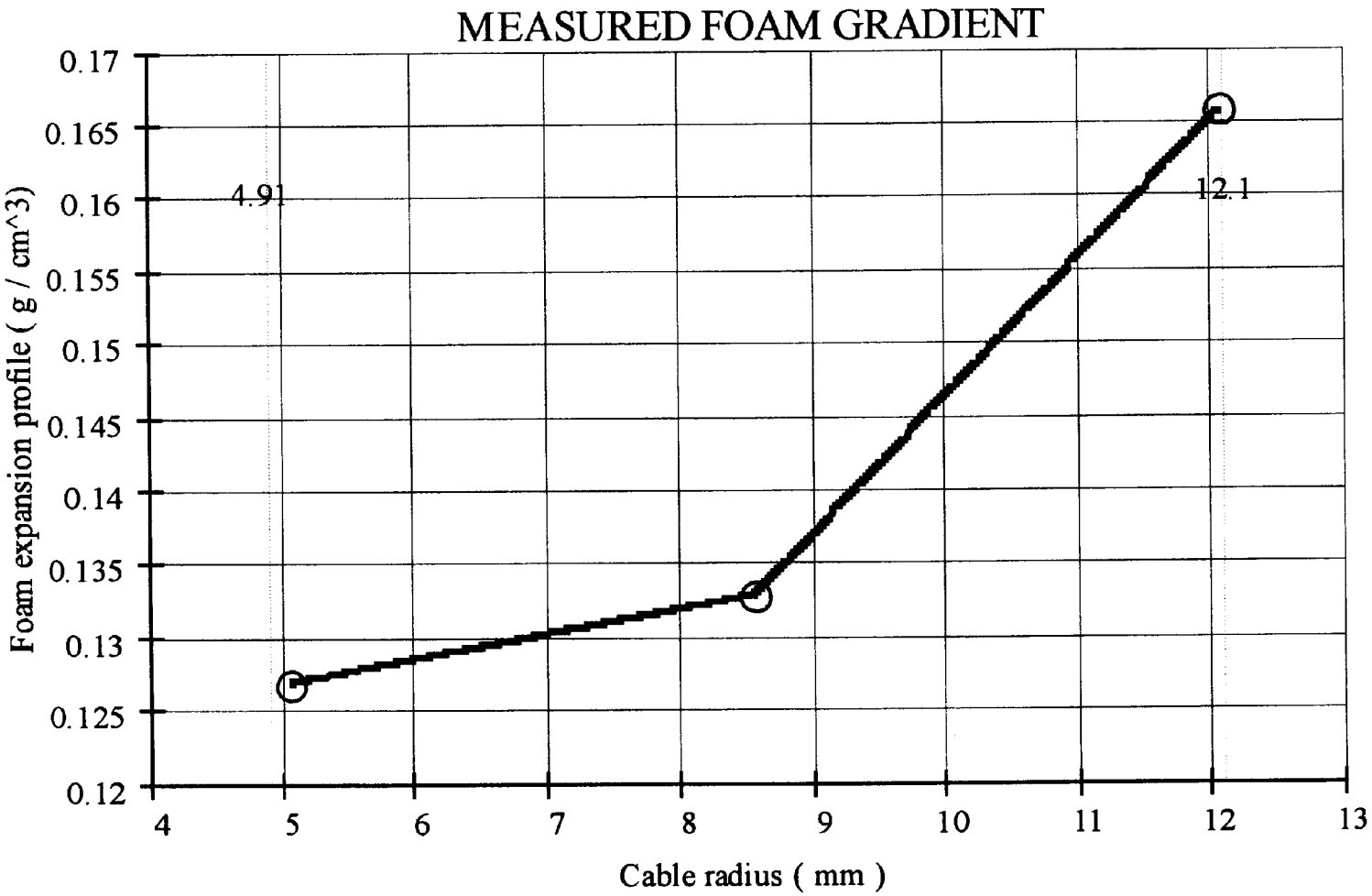
FIG. 7 is a graph of foam density as a function of cable radius.

One way that small positive gradients are produced in the foam density is by adjusting cooling profiles. A core of the size of FIG. 4 was processed to have this type of profile. Measured density values for the foam core are shown in FIG. 7. Assuming a constant slope between the measured data points, as indicated in the graph, the attenuation for a cable with this core density would be the same as one with uniformly expanded foam that must be 4.4% lighter.

The coaxial cable of this invention has a corrugated outer conductor, a foamed polymeric dielectric with an overall density of 0.17 g/cm$^3$ or lower, a velocity of propagation exceeding 90%, and handling and bending characteristics typical of those of traditional corrugated outer conductor cables. Typical measured values for velocity, bend life (number of reverse bends on the minimum bend radius) and crush strength are:

| | |
|---|---|
| Velocity | 91% |
| Bend life | 30 |
| Crush strength | 100 lbs per linear inch. |

Additionally the cable has reduced attenuation compared with a standard velocity cable of the same size (1.73 dB/100 ft compared with 1.86 dB/100 ft at a frequency of 2 GHz) which is advantageous because of the corresponding reductions in transmit and receive path losses.

What is claimed is:

1. A coaxial cable comprising an inner conductor, a foamed polymeric dielectric surrounding said inner conductor and having a density below 0.17 g/cm$^3$, and a corrugated outer conductor surrounding said dielectric and dimensioned to create a ratio of the actual length of said outer conductor to its linear length such that the cable has a velocity of propagation greater than 90% of the speed of light, the corrugations in said outer conductor forming troughs and crests with the troughs engaging said dielectric.

2. The coaxial cable of claim 1 which has a bend life of at least 30 reverse bends on the minimum bend radius.

3. The coaxial cable of claim 1 which has a crush strength of at least 100 pounds per linear inch.

4. The coaxial cable of claim 1 which has an attenuation of less than about 1.80 dB/100 feet at 2 GHz for a nominal 1 inch diameter cable.

5. The coaxial cable of claim 1 which has a velocity of at propagation greater than 91% of the speed of light.

6. The coaxial cable of claim 1 in which the density of said dielectric and the ratio of the actual length of said outer conductor to its linear length are selected to provide a cable having a bend life of at least 30 reverse bends on the minimum bend radius and a velocity of propagation of at least 90% of the speed of light.

7. The coaxial cable of claim 1 in which the ratio of the actual length of said outer conductor to its linear length is less than about 1.11 for a cable having an outside diameter of about one inch.

8. The coaxial cable of claim 1 in which the ratio of the actual length of said outer conductor to its lineal length is less than or equal to 1.125 for a cable having an outside diameter of about 1.4 inches.

9. The coaxial cable of claim 1 in which the density of the foam dielectric at the outer conductor is at least 20% greater than at the inner conductor.

10. A method for producing a coaxial cable comprising:

providing an inner conductor;

surrounding the inner conductor with a foamed polymeric dielectric, the foamed dielectric having a density below 0.17 g/cm$^3$; and surrounding the foamed polymeric dielectric with a corrugated outer conductor, the outer conductor forming troughs and crest with the troughs engaging the dielectric, the ratio of the actual length of the outer conductor to its linear length being selected to provide the cable with a velocity of propagation greater than 90% of the speed of light.

11. The method of claim 10, wherein the coaxial cable has a bend life of at least 30 reverse bends on the minimum bend radius.

12. The method of claim 10, wherein the coaxial cable has a crush strength of at least 100 pounds per linear inch.

13. The method of claim 10, wherein the coaxial cable of claim 1 has an attenuation of less than about 1.80 db/100 feet at 2 GHz for a nominal 1 inch diameter cable.

14. The method of claim 10, wherein the ratio of the actual length of the outer conductor to its linear length is selected to provide a velocity of propagation greater than 91% of the speed of light.

15. The method of claim 10, further comprising selecting a density of said dielectric and adjusting the ratio of the actual length of said outer conductor to its linear length to provide a cable having a bend life of at least 30 reverse bends on the minimum bend radius and a velocity of propagation of at least 90% of the speed of light.

16. The method of claim 10, wherein the ratio of the actual length of the outer conductor to its linear length is less than 1.11 for a cable having an outside diameter of about one inch.

17. The method of claim 10, wherein the ratio of the actual length of the outer conductor to its linear length is less than or equal to 1.125 for a cable having an outside diameter of about 1.4 inches.

18. The method of claim 10, wherein the step of surrounding the inner conductor with the foamed dielectric comprises providing the foam dielectric at a density that is at least 20% greater at the outer conductor than the inner conductor.

* * * * *